US005385230A

United States Patent [19]

Nygard et al.

[11] Patent Number: 5,385,230

[45] Date of Patent: Jan. 31, 1995

[54] ADJUSTABLE TRAY ASSEMBLY FOR USE IN DESK DRAWERS

[75] Inventors: James C. Nygard, Maplewood; Dorman N. Thompson, Woodbury; William H. Sheeler, Minneapolis; Alden R. Miles, Burnsville; David C. Windorski, Woodbury; Bruce W. Carlson, Minneapolis, all of Minn.; Dennis L. Crawford, Roberts, Wis.

[73] Assignee: Minnesota Mining and Manufacturing Company, St. Paul, Minn.

[21] Appl. No.: 640,030

[22] Filed: Jan. 11, 1991

[51] Int. Cl.[6] ..... B43M 17/00; B65D 85/671; B65D 85/28; A45C 11/34

[52] U.S. Cl. ..... 206/214; 206/371; 206/447; 220/8

[58] Field of Search ..... 206/44 B, 576, 224, 206/225, 411, 371, 214, 561, 564, 447; 220/8; 211/10, 11, 50, 126, 69.1, 69.5; 221/303, 309, 45, 46

[56] References Cited

U.S. PATENT DOCUMENTS

| | | | |
|---|---|---|---|
| 2,953,244 | 9/1960 | Phillips | 220/8 X |
| 3,232,439 | 2/1966 | Dahl, Jr. | 211/10 |
| 3,243,049 | 3/1966 | Seligmann, Jr. et al. | 211/126 |
| 3,463,343 | 8/1969 | Asenbauer | 220/8 |
| 3,708,709 | 1/1973 | Morrison et al. | 211/126 X |
| 3,887,102 | 6/1975 | Earley | 220/8 |
| 4,176,743 | 12/1979 | Fitzpatrick | 211/69.5 |
| 4,320,835 | 3/1982 | Polhemus et al. | 206/411 |
| 4,406,368 | 9/1983 | Hermes | 206/371 |
| 4,489,831 | 12/1984 | Lahneman III | 206/371 |
| 4,512,503 | 4/1985 | Gioso | 206/371 X |
| 4,591,056 | 5/1986 | Groch | 206/214 X |
| 4,651,878 | 3/1987 | Hafner | 211/69.1 X |
| 4,696,399 | 9/1987 | Windorski | 206/565 |
| 4,699,277 | 10/1987 | Baxter | 211/11 X |
| 4,768,298 | 9/1988 | Polhemus et al. | 40/358 |
| 4,770,320 | 9/1988 | Miles et al. | 221/33 |
| 4,907,703 | 3/1990 | Alger et al. | 211/10 |
| 4,919,276 | 4/1990 | Kim et al. | 211/69.1 X |
| 4,921,127 | 5/1990 | Windorski | 221/45 |
| 4,941,576 | 7/1990 | Sugerman et al. | 211/13 |
| 4,964,519 | 10/1990 | Sugerman et al. | 211/50 |
| 5,016,772 | 5/1991 | Wilk | 220/8 |
| 5,031,769 | 7/1991 | Shea et al. | 220/8 X |
| 5,040,681 | 8/1991 | Grusin | 206/371 X |

FOREIGN PATENT DOCUMENTS

| | | |
|---|---|---|
| 2157155A | 10/1985 | United Kingdom . |
| WO88/07342 | 10/1988 | WIPO . |

OTHER PUBLICATIONS

PCT Search Report PCT/US91/09039.

*Primary Examiner*—Jacob K. Ackun, Jr,
*Attorney, Agent, or Firm*—Gary L. Griswold; Walter N. Kirn; William L. Huebsch

[57] ABSTRACT

An adjustable tray assembly adaptable for use in desk drawers having side walls spaced at various distances. The tray assembly includes a first portion having a plurality of open top receptacles and a support lip projecting away from one side, and a second portion also with a projecting support lip and mounted on the first portion to affording relative movement between the portions to change the spacing between the first and second support lips so that they can be supported on the upper edge surfaces of the side walls of the drawers of different widths with the first and second portions bridging therebetween. The tray assembly can also include dispensers for office supplies including note paper, tape flags and tape; the tape dispenser being of a novel low profile design.

16 Claims, 6 Drawing Sheets

ADJUSTABLE TRAY ASSEMBLY FOR USE IN DESK DRAWERS

TECHNICAL FIELD

The present invention relates to trays adapted for use in desk drawers to help contain and organize office supply items.

BACKGROUND ART

Trays are currently available for use in desk drawers to help contain and organize office supply items such as staples, paper clips and rubber bands. Typically such trays have generally planar top surfaces, and walls defining a plurality of receptacles having openings adjacent the top surface in which the supply items are contained. Some trays of this type are adapted to be supported on the bottom wall of drawers, whereas others have support lips projecting from opposite sides adapted to be supported on the upper surfaces of the side walls of desk drawers and to bridge between those side walls. Known trays of this latter type are typically supplied with a desk and are adapted for a desk drawer of a predetermined width, or are adapted for use in desk drawers having a small range of widths (e.g., the "Mini Catch'all" sold by Eldon Office Products, Carson, Calif., which claims to fit drawers 12 and 1/16 inch to 12 and ⅜ inch wide).

DISCLOSURE OF INVENTION

The present invention provides a tray assembly for use in desk drawers to help contain and organize office supply items, which tray assembly is adapted to be supported on and bridge between the side walls of a desk drawer, and is adjustable over a wide range of widths to afford using the tray assembly in desk drawers of different widths. Also, the tray assembly can be adapted to organize, contain and dispense items in addition to those traditionally organized and contained in such trays, including sheets of note paper, tape flags, and lengths of pressure sensitive adhesive coated tape.

Generally, the tray assembly according to the present invention has a generally planar top surface and comprises (1) a first portion, walls forming a main part of the first portion defining a plurality of receptacles having openings adjacent the top surface, and a first support lip adjacent the top surface, projecting away from the main part generally parallel to the top surface, and adapted to be supported on the upper edge surface of one of the side walls of the desk drawer; (2) a second portion comprising two spaced parallel side walls having top and bottom edges and first and second ends with the side walls being elongate between the first and second ends, an end wall extending between the first ends of the side walls and having top and bottom edges, a bottom wall joined to and extending between the side and end walls adjacent the bottom edges of the side and end walls, the side and bottom walls having adjacent inner surfaces; and a second support lip projecting from adjacent the top surface of the end wall on the side of the end wall opposite the side walls and adapted to be supported on the upper edge surface of one of the side walls of the desk drawer; and (3) means in engagement between the first and second portions for positioning at least a portion of the main part along the inner surfaces of the side and bottom walls of the second portion, and for affording relative movement of the first and second portions in a direction parallel to the longitudinal direction of the side walls to change the spacing between the end wall of the second portion and the main part of the first portion and thereby the spacing between the support lips on the first and second portions so that the spacing may be manually adjusted to position the support lips on the upper edge surfaces of the side walls of the drawers of different widths with the first and second portions bridging therebetween.

Also, the tray assembly can include walls walls defining a novel dispenser for tape from a roll of pressure sensitive adhesive coated tape, which walls include (1) cavity defining walls defining a cavity including a bottom wall having a normally horizontally extending support surface supporting one side surface of the roll of tape, the walls having abutment surfaces (which can be arcuate about axes extending generally normal to the support surface) projecting generally normal to the support surface and spaced by a dimension less than the diametrical dimension of a core about which the tape is wound to define an exit opening between the abutment surfaces through which the tape may be withdrawn from the roll; (2) passageway defining walls defining an exit passageway extending in a direction generally parallel with the support surface and communicating with the exit opening, one of the passageway defining walls defining a guide edge surface generally parallel to the support surface and positioned on the side of the passageway opposite the support surface, which guide edge surface defines the end of the exit passageway opposite the exit opening and is adapted to be engaged by the first surface of the backing with the guide edge surface extending generally transverse of the backing, the guide edge surface being spaced from the exit opening by at least about 2 times the width of the tape to afford longitudinal twisting of the tape along the passageway by about 90 degrees between the exit opening and the guide edge surface to position the first surface of the backing along the guide edge surface, and being spaced normal to a plane coplanar with the support surface by a distance in the range of about 0.5 to 1.25 times the width of the tape; and (3) tape end portion positioning walls defining a land surface adapted to have the pressure sensitive adhesive coating on the tape releasably adhered thereto, a space between the land surface and the guide edge surface affording positioning a users finger along the adhesive coated surface of the tape between the guide surface and the land surface, pealing of the tape from the land surface, and subsequently withdrawal of tape from the roll by the user; and a cutter blade mounted at the end of the land surface opposite the guide surface and adapted for severing a length of tape withdrawn from the roll. In a preferred embodiment of the tray assembly, the walls defining the land surface are disposed generally centrally along the lip on the first portion of the tray assembly, and the exit passageway extends generally at a right angle away from that lip.

The dispenser for tape described above provides a low vertical profile which makes it useful for incorporation in a tray assembly of the type described above, but could also be made separate from the tray assembly as a low profile tape dispenser for use on desk or table tops and which, because it has no hub on which the roll of tape is journalled, is more easily loaded with tape than the low profile tape dispensers described in U.S. Pat. No. 4,320,835. The dispenser is particularly useful when incorporated in a tray assembly of the type comprising support lips adapted to be supported on the upper edge surfaces of the side walls of desk drawers (whether or not the tray assembly is adjustable in width) when the land surface for the tape is disposed along one of the lips, and the exit passageway for the tape extends generally at a right angle away from that lip. This positioning allows a length of tape withdrawn from the dispenser to be pulled away from the side of the drawer and to then be pulled down well below the top edge of the drawer to engage the withdrawn length of tape with the cutter blade to sever it from the tape supply. Such engagement of the tape with the cutter blade is more difficult with low profile tape dispensers on a desk when a long length of tape is withdrawn along the desk top, and can require two hand to sever the tape without causing the tape to contact the desk top.

The tray assembly can also incorporate a dispenser for sheets of note paper, such as the type described in U.S. Pat. No. 4,921,127 with reference to FIGS. 10 through 12 (the content of which patent is incorporated herein by reference) and generally of the type described with reference to FIGS. 1 through 6 in U.S. Pat. No. 4,696,399 (the content of which patent is also incorporated herein by reference), and can incorporate means for holding a number of dispensers for tape flags of different colors of the type described in U.S. Pat. No. 4,770,320 (the content of which patent is also incorporated herein by reference).

BRIEF DESCRIPTION OF DRAWING

The present invention will be further described with reference to the accompanying drawing wherein like reference numerals refer to like parts in the several views, and wherein.

DETAILED DESCRIPTION

Figure 1:
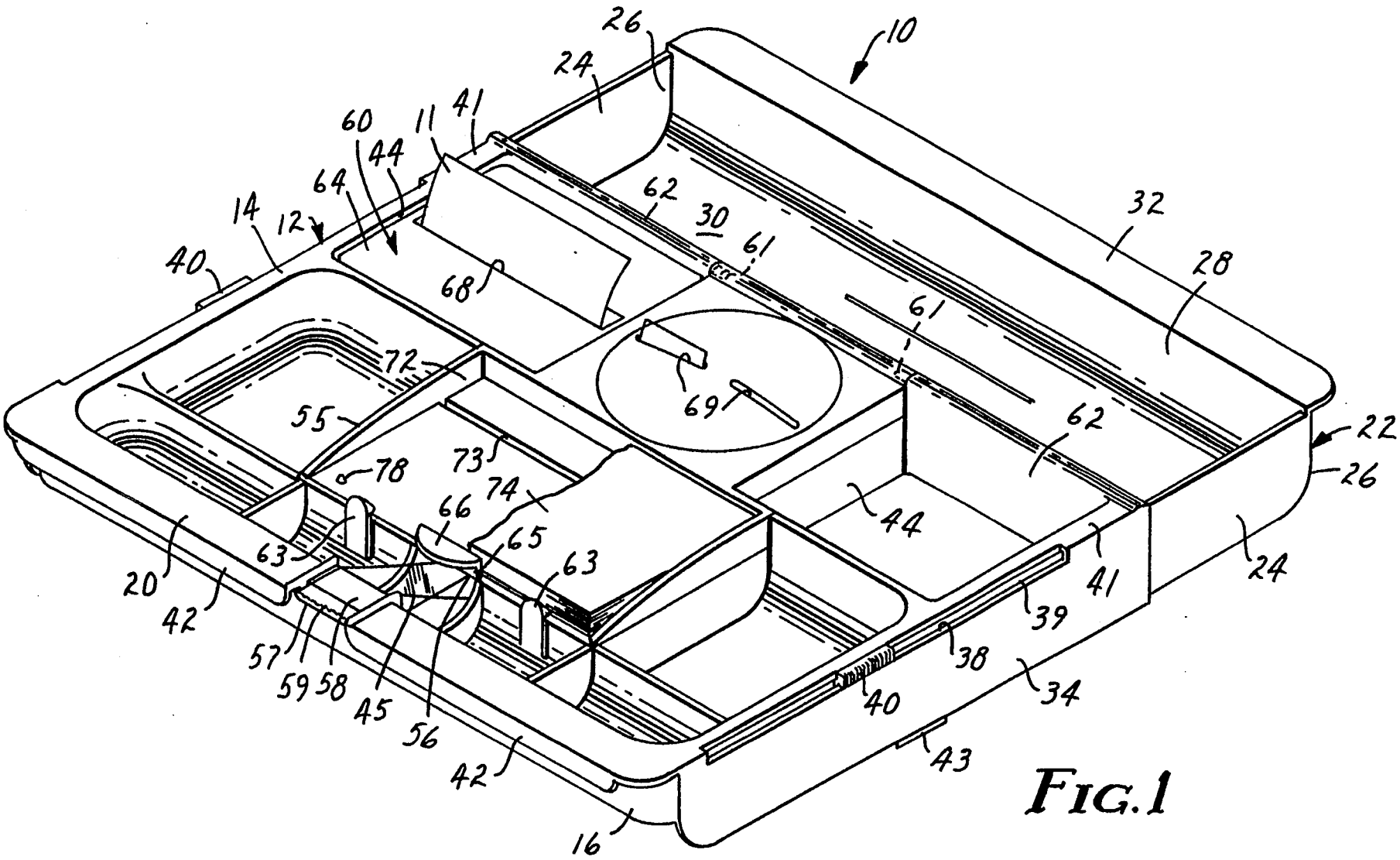
FIG. 1 is a perspective view of a tray assembly according to the present invention.

Referring now to the drawing, there is shown a tray assembly according to the present invention generally designated by the reference numeral 10, which tray assembly 10 is adaptable for use in desk drawers of the types having side walls with parallel upper edge surfaces spaced at various distances.

Generally the tray assembly 10 has a generally planar top surface 14, and comprises (1) a first portion 12, walls forming a main part 16 of the first portion 12 comprising a plurality of receptacles having openings adjacent the top surface 14, and a first support lip 20 adjacent and defining a portion of the top surface 14, which first support lip 20 projects away from the main part 16 in a direction generally parallel to the top surface 14 and is adapted to be supported on the upper edge surface of one of the side walls of a desk drawer; (2) a second portion 22 comprising two spaced parallel side walls 24 having top and bottom edges and first and second ends 26 and 27 with the side walls 24 being elongate between the first and second ends 26 and 27, an end wall 28 extending between the first ends 26 of the side walls 24 and having top and bottom edges, a bottom wall 30 joined to and extending between the side and end walls 24 and 28 adjacent the bottom edges of the side and end walls 24 and 28, the side and bottom walls 24 and 30 having adjacent inner surfaces; and a second support lip 32 adjacent and defining a portion of the top surface 14, which second support lip 32 projects away from the end wall 28 on the side of the end wall 28 opposite the side walls 24 and is adapted to be supported on the upper edge surface of one of the side walls of a desk drawer; and (3) means in engagement between the first and second portions 12 and 22 for positioning at least a portion of the main part 16 along the inner surfaces of the side and bottom walls 24 and 30 of the second portion 22, for affording relative movement of the first and second portions 12 and 22 in a direction parallel to the longitudinal direction of the side walls 24 to change the spacing between the end wall 28 of the second portion 22 and the main part 16 of the first portion 12 and thereby the spacing between the first and second support lips 20 and 32 on the first and second portions 12 and 22 so that the spacing may be manually adjusted to position the support lips 20 and 32 on the upper edge surfaces of the side walls of drawers of different widths with the first and second portions 12 and 22 bridging therebetween, such as on the side walls 33 illustrated in FIGS. 4 through 7.

Figure 8:
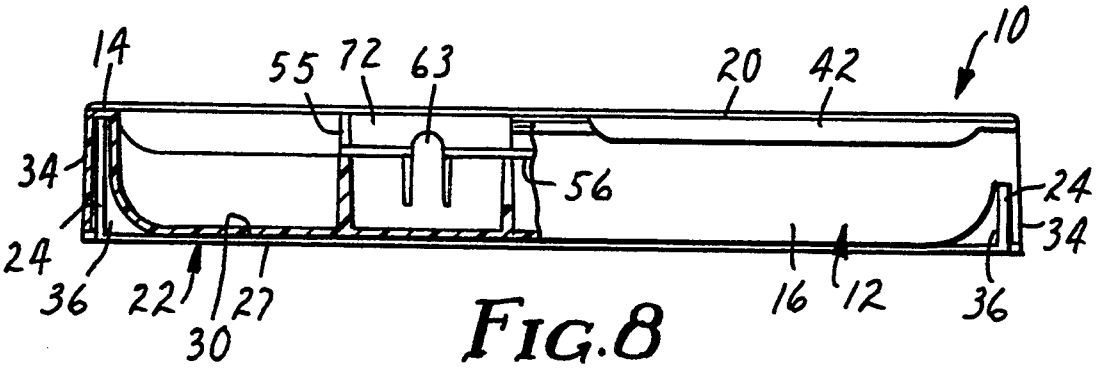
FIG. 8 is a sectional view taken approximately along line 8—8 of FIG. 3.
Figure 9:
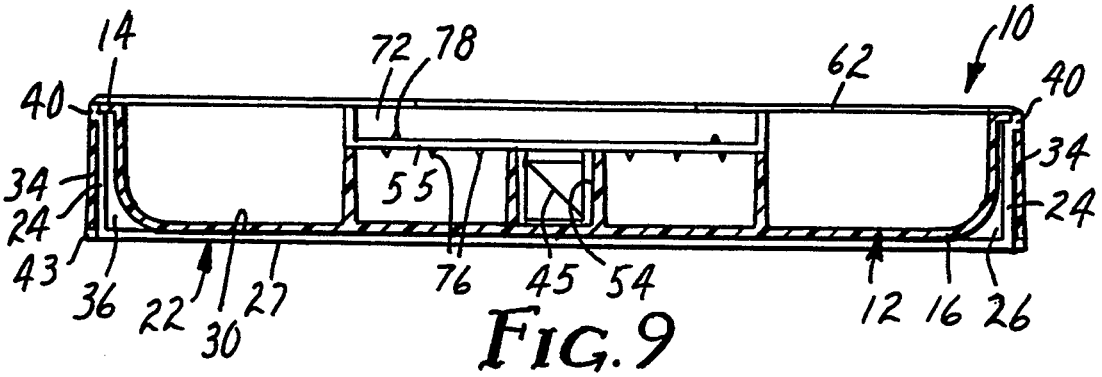
FIG. 9 is a sectional view taken approximately along line 9—9 of FIG. 3.

Surfaces of the walls of the first portion 12, including inner surfaces of outer guide walls 34 and adjacent surfaces of the main part 16, define elongate spaces 36 (see FIGS. 8, 9 and 10) opening through the bottom of the first portion 12 opposite the top surface 14, which spaces 36 are adapted to closely receive the side walls 24 of the second portion 22 with the main part 16 of the first portion 12 along and closely spaced from the inner surfaces of the side and bottom walls 24 and 30 and afford longitudinal movement of the side walls 24 along the elongate spaces 36 to change the spacing between the support lips 20 and 32 on the first and second portions 12 and 22; and retaining means are provided for retaining the side walls 24 within the elongate spaces 36 defined by the wall surfaces of the first portion 12 in opposition to the separating forces therebetween caused by the weight of the first and second portions 12 and 22 and any objects contained within the tray assembly 10 when the tray assembly 10 is supported only by support lips 20 and 32 and thus bridges between the support lips 20 and 32. That retaining means is in part provided by the outer guide walls 34 having top surface portions 38, the walls of the first portion 12 having elongate slots 39 communicating with the elongate spaces 36 that are partially defined by the top surface portions 38, and each of the side walls 24 of the second portion 22 having a lug 40 projecting through the adjacent slot 39 with an end portion of the lug 40 positioned to bear against the top surface portion 38 of the adjacent guide wall 34 and adapted to move along the slots 39 and the top surface portions 38 when the side walls 24 are moved along the spaces 36. Such engagement between the lugs 40 and the top surface portions 38 and engagement between portions of the top surfaces of the side walls 24 and walls 41 of the first portion 12 bridging between its side walls 24 and its main part 16 at the ends of the slots 39 opposite the first support lip 20 provide that retaining means when the tray assembly 10 is supported only by the support lips 20 and 32.

Each of the side walls 24 of the second portion 22 also has a guide plate 43 projecting along the bottom surface of the adjacent guide wall 34 and adapted to move along that bottom surface and help orient the side walls 24 in the spaces 36 when the side walls 24 are moved along the spaces 36.

Retaining means are provided for releasably retaining the side walls 24 at a predetermined position longitudinally along the elongate spaces 36 in the first portion 12 when the tray assembly 10 is supported only along lower surfaces of the support lips 20 and 32, as by the side walls 33 of a drawer. The retaining means in the tray assembly 10 are provided by the support lips 20 and 32 having distal edge portions 42 (see FIGS. 4 through 7) projecting away from the top surface 14 of the tray assembly 10, which distal edge portions 42 are adapted to engage the outer surfaces of the side walls 33 of the drawer adjacent the upper surfaces of the drawer on which the support lips 20 and 32 are supported. Alternatively, the support lips 20 and 32 could be provided without such distal edge portions 42, and the retaining means could be provided by the side walls 24 having spaced transverse shallow notches along its top surface portions 38, and the lugs 40 having transverse projections adapted to engage the notches and thereby restrict movement of the side walls 24 along the elongate spaces 36 when the lugs 40 are biased against the top surface portions 38 by the tray assembly being supported only by the support lips 20 and 32.

Figure 10:
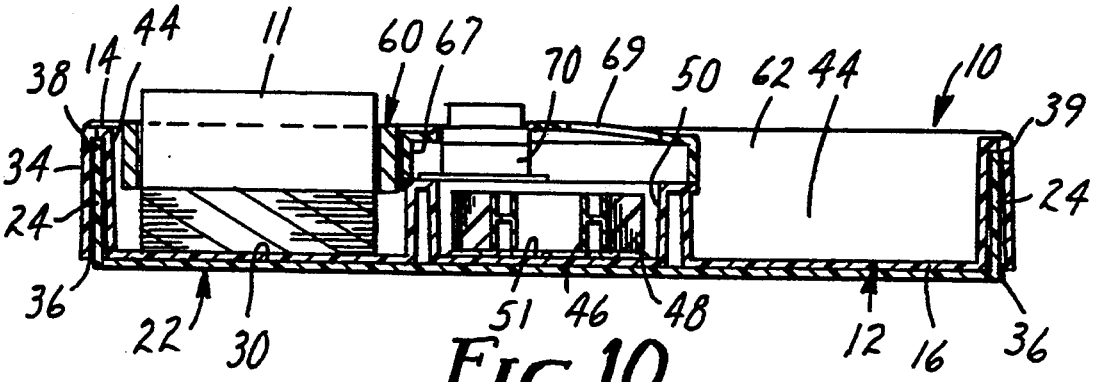
FIG. 10 is a sectional view taken approximately along line 10—10 of FIG. 3 illustrating a Tape Flag dispenser in the tray assembly.

Preferably, one of the receptacles 44 in the main part 16 of the first portion 12 has a rectangular shape adapted to provide the base for a refillable dispenser 60 described with reference to FIGS. 10, 11 and 12 of U.S. Pat. No. 4,921,127, the content whereof is incorporated herein by reference. That dispenser 60 also includes a body 64 described in that patent which has a slot 68 through which sheets 11 of note paper each having a narrow band of repositionable pressure sensitive adhesive coated on one surface along one edge can be pulled from a stack of the sheets 11 in the dispenser 60 in which stack the sheets 11 are positioned with the band of adhesive of adjacent sheets 11 located at alternate opposite edges of the stack.

The walls of the first portion 12 also include walls defining a dispenser for tape 45 of the conventional type comprising a backing having first and second major surfaces, opposite longitudinal edges spaced by a dimension W (e.g., 1.9 centimeters or 0.75 inch), and a coating of pressure sensitive adhesive along the second surface of the backing, which tape 45 is helically wound about the peripheral surface of a core 46 having a diametrical dimension D (e.g., 3.6 centimeters or 1.43 inches) and opposite side surfaces spaced by about the dimension W to form a roll 48 having opposite side surfaces defined by the edge surfaces of the backing and side surfaces of the core 46 with the first major surface of the backing being disposed radially outwardly from the second major surface of the tape 45 in the roll (e.g., a roll of the ¾ inch wide pressure sensitive adhesive coated tape sold under the trade designation "810 Scotch Brand Magic Tape" by Minnesota Mining and Manufacturing Company, St. Paul, Minn.).

The walls defining the dispenser for the tape 45 include cavity defining walls defining a generally cylindrical cavity 50 in the main portion 16 including a bottom wall having a normally horizontally extending support surface 51 adapted to supporting one side surface of the roll 48 of tape 45. The cavity defining walls include walls having abutment surfaces 52 projecting generally normal to the support surface 51 and spaced by a dimension less than the diametrical dimension of the core 46 (e.g., 1.9 centimeters or 0.75 inch) to define an exit opening between the abutment surfaces 52 through which the tape 45 may be withdrawn from the roll 48. The spaced abutment surfaces 52 are adapted to be contacted by the cylindrical periphery of the toll 48 of tape 45, are generally arcuate or cylindrically convex about axes extending generally normal to the support surface 51, and as illustrated are defined by spaced parallel axially extending ridges.

Preferably, as illustrated, the support surface 51 is discontinuous and defined by a plurality of spaced wall portions to restrict adhesion between the support surface 51 and any adhesive along the side surface of the roll of tape 45.

The walls defining the dispenser for the tape 45 also include passageway defining walls including walls in the main portion 16 defining an elongate exit passageway 54 extending in a direction generally parallel with the support surface 51 at a right angle with respect to the first support lip 20 and communicating with the exit opening defined by the abutment surfaces 52, and a pivotable wall 55 (later described in detail) defining a guide edge surface 56 generally parallel to the support surface 51 on the side of the exit passageway 54 opposite the support surface 51, defining the end of the exit passageway 54 opposite the exit opening, and adapted to be engaged by the first surface of the backing of the tape 45 with the guide edge surface 56 extending generally transverse of the backing. The guide edge surface 56 is spaced from the exit opening by at least about 1.3 times W (e.g., 2.5 centimeters or 0.97 inches for 0.75 inch wide tape) and preferably at least about 2.3 times W (e.g., 4.4 centimeters or 1.72 inches for 0.75 inch wide tape) to afford longitudinal twisting of the tape 45 along the exit passageway by about 90 degrees between the exit opening and the guide edge surface 56 to position the first surface of the tape backing along the guide edge surface 56 and parallel with the top surface 14 of the tray assembly 10. The guide edge surface 56 is also spaced normal to an imaginary plane coplanar with the support surface 51 by a distance in the range of about 0.5 times W to about 1.25 times W (e.g., 0.95 centimeter or 0.375 inch to 2.38 centimeters or 0.94 inch for 0.75 inch wide tape), which as illustrated is about 1.21 times W (e.g., 2.3 centimeters or 0.91 inch). When the indicated preferred positioning for the guide edge surface 56 is used, no top surface is needed for the cylindrical cavity 50. When the minimum distance is used between the guide edge surface 56 and the exit opening, however, a top surface may be needed for the cavity 50 to keep the roll 48 of tape 45 from pivoting toward a vertical position in the cavity 50.

As illustrated, the guide edge surface 56 and the spaced abutment surfaces 52 are fixed, however these surfaces could also be provided by rotatably mounted rollers.

Additionally, the walls defining the dispenser for the tape 45 include tape 45 end portion positioning walls including a bent metal plate 57 defining a land surface 58 adapted to have the pressure sensitive adhesive coating on the tape 45 releasably adhered thereto, and walls in the main part 16 defining a socket for an end portion of the plate 57 to position the land surface 58 generally centrally along the first support lip 20. The tape 45 end portion positioning walls also include walls in the main part 16 defining a space between the land surface 58 and the guide edge surface 56 affording positioning a users finger along the adhesive coated surface which allows a user to insert his or her finger between the guide edge surface 56 and the land surface 58 from above the top surface 14 of the tray assembly 10, to peal the end of the tape 45 from the land surface 58, and to subsequently withdraw tape 45 from the roll 48. The plate 57 has a serrated tape cutting blade 59 of a conventional type formed at the end of the land surface 58 opposite the guide edge surface 56 where the cutting blade 59 can be used to sever a length of tape 45 withdrawn from the roll 48 by the user.

Figure 2:
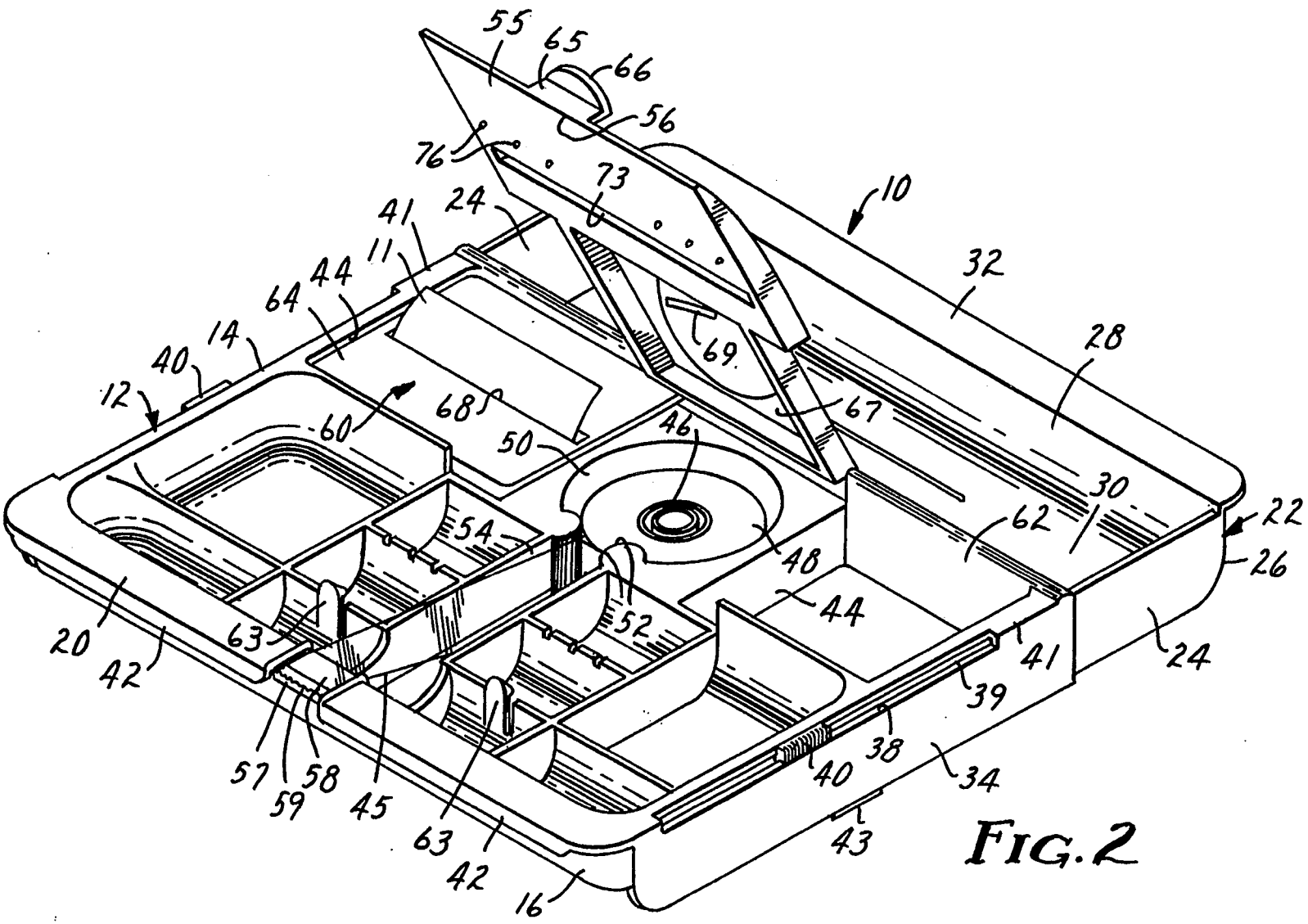
FIG. 2 is a perspective view of the tray assembly of FIG. 1 in which a pivotable wall of the tray assembly shown in an open position.
Figure 3:
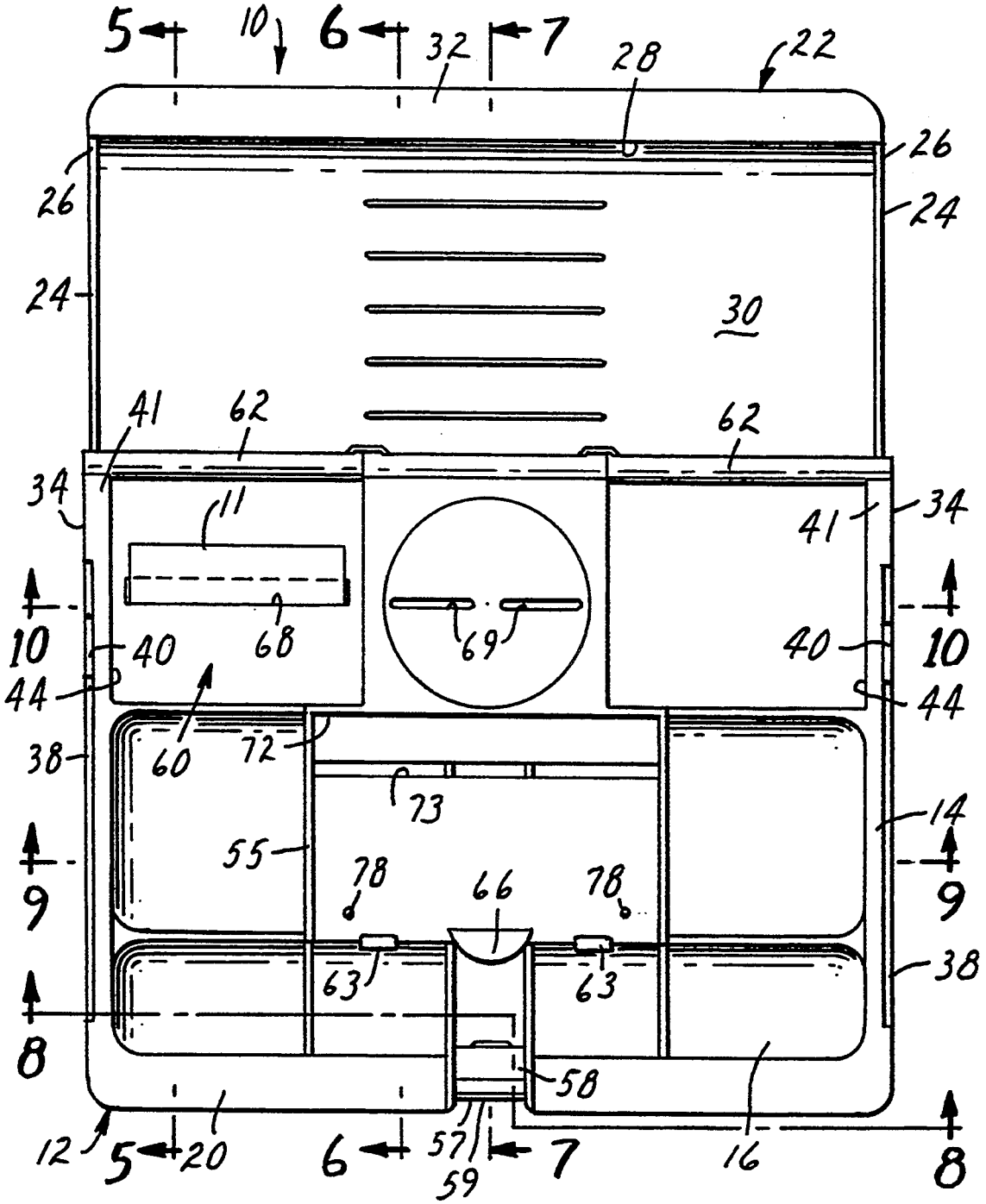
FIG. 3 is a top view of the tray assembly of FIG. 1.
Figure 4:
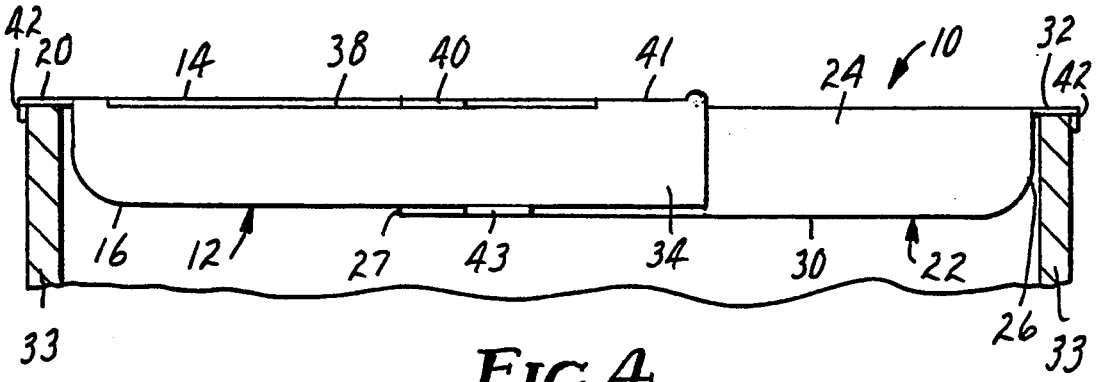
FIG. 4 is a sectional view taken approximately along line 4—4 of FIG. 3 and modified to illustrate fragments of side walls of a desk drawer on which the tray assembly is supported.
Figure 5:
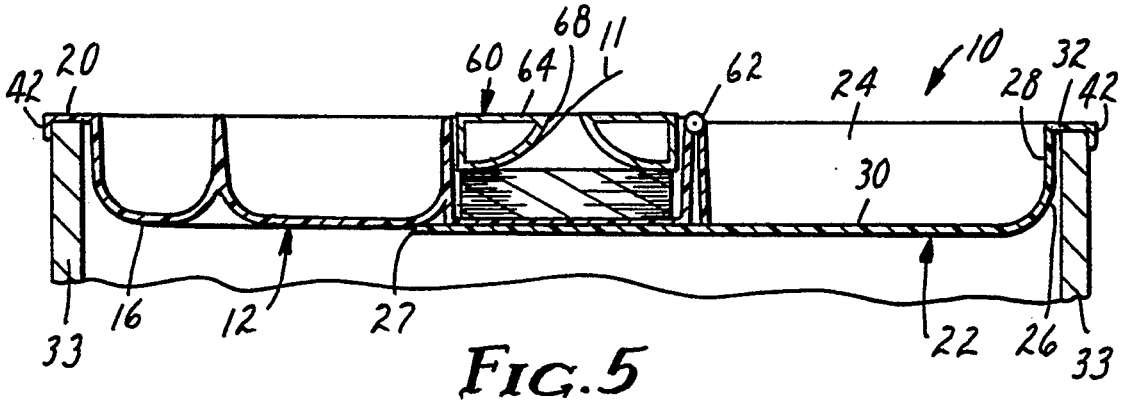
FIG. 5 is a sectional view taken approximately along line 5—5 of FIG. 3 and modified to illustrate fragments of side walls of a desk drawer on which the tray assembly is supported.
Figure 6:
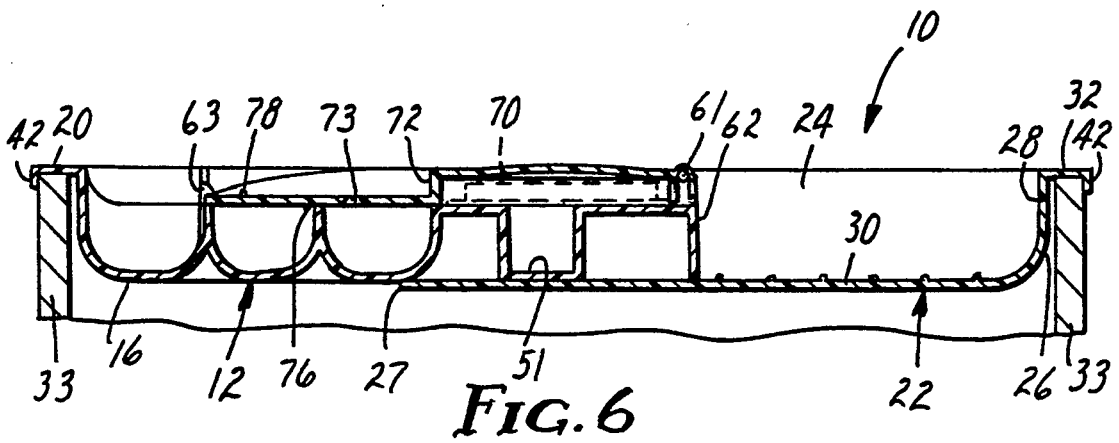
FIG. 6 is a sectional view taken approximately along line 6—6 of FIG. 3 and modified to illustrate fragments of side walls of a desk drawer on which the tray assembly is supported.
Figure 7:
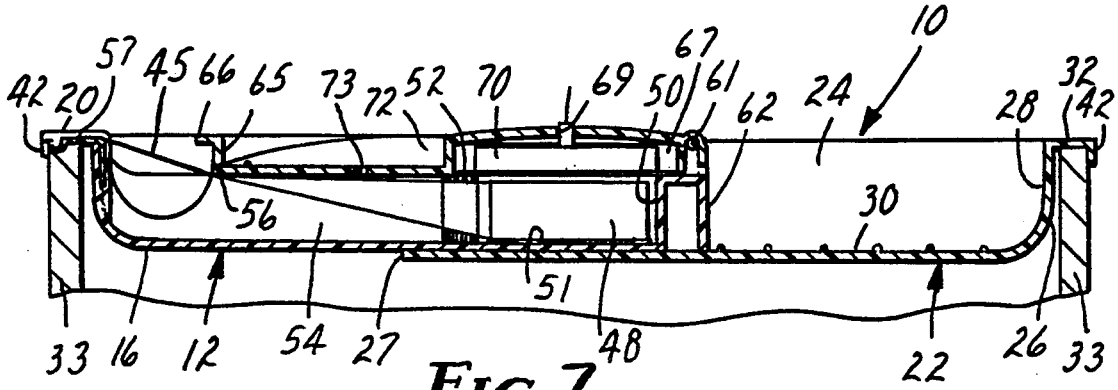
FIG. 7 is a sectional view taken approximately along line 7—7 of FIG. 3 illustrating a Tape Flag dispenser in the tray assembly and modified to illustrate fragments of side walls of a desk drawer on which the tray assembly is supported.

The pivotable wall 55 defining the guide edge surface 56 has a transverse generally U-shaped channel at its end opposite the guide edge surface 56, which channel receives in its opposite ends opposed pins 61 projecting toward each other from the ends of a slot defined by and centrally located along an upper portion of an end wall 62 of the main part 16 to mount the wall 55 for pivotable movement about an axis defined by the pins 61 between a normal or closed position (FIGS. 1 and 3) with the pivotable wall 55 adjacent or contacting the tops of walls defining the cavity 50 and the exit passageway 54 in the main part 16 and the guide edge surface 56 at its desired position (see FIG. 7) at the end of the exit passageway 54 for use in dispensing tape 45 from the dispenser; and an open position (see FIG. 2) with the wall 55 pivoted away from the walls defining the cavity 50 and the exit passageway 54 in the main part 16 so that a new roll of tape 45 may be substituted for a tape core 46 in the cavity 50, and the tape 45 from the new roll can be properly positioned along the exit passageway 54 and adhered to the land surface 58 so that it can be dispensed after the wall 55 is pivoted back to its normal or closed position. Means are provided for releasably retaining the pivotable wall 55 in its closed position, which means are provided by resiliently flexible vertically projecting retaining tabs 63 having lips adjacent their distal ends adapted to engage the surface of the pivotable wall 55 opposite the main part 16, and having cam surfaces on the lips that by engagement from the edge of the wall 55 cause the tabs 63 to flex away from the wall 55 and allow the wall 55 to move past the lips in either direction when a moderate force is applied to the wall 55 to move it to or away from its closed position. The pivotable wall 55 also includes a vertically projecting lug 65 having a lip 66 at its distal end projecting generally parallel to the top surface 14, by which lip 66 the lug 65 may be manually engaged to move the wall 55 between its open and closed positions.

The portion of the pivotable wall 55 adjacent the pins 61 defines a shallow recess 67 opening toward the main part 16 of the first portion 12 and has spaced aligned transversely extending through slots 69, which recess 67 and slots 69 are adapted to receive two of the "Post-it" brand Tape Flag dispensers 70 (only one of which is shown, see FIGS. 7 and 10) commercially available from 3M Commercial Office Supply Division, St. Paul, Minn., and described in U.S. Pat. No. 4,770,320, (the content of which is incorporated herein be reference) with the main portions of the dispensers 70 side by side in the recess 67, and projections on the dispensers 70 defining outlet openings for the Tape Flags frictionally engaged with the surfaces of the wall 55 defining the slots 69. Tape Flags from the dispensers 70 will thus project from the upper surface of the wall 55 where they can easily be manually withdrawn from the dispensers 70.

A portion of the pivotable wall 55 opposite the pins 61 defines a shallow recess 72 opening away from the main part 16 of the first portion 12 and has a transverse slot 73. The shallow recess 72 is adapted to receive a pad 74 of note paper of the type in which the sheets are held together in the pad 74 by a narrow band of repositionable pressure sensitive adhesive along on one side of each sheet and adjacent one edge of the pad 74 (e.g., a pad of 7.6 by 12.7 centimeter or 3 by 5 inch Post-it brand notes commercially available from 3M Commercial Office Supply Division, St. Paul, Minn.). The side of the pad 74 along which the bands of adhesive are disposed is positioned on the side of the recess 72 adjacent the pins 60. A portion of the bottom sheet of the pad 74 spaced from the band of adhesive is positioned so that it projects through the slot 73 and a row of pointed teeth 76 projecting from the side of the wall 55 adjacent the main part 16 pierce the bottom sheet where the bottom sheet bridges teeth receiving sockets in the main part 16. The teeth 76 together with clamping of that pierced portion of the bottom sheet between the wall 55 and the main part 16 hold the bottom sheet of the pad 74, which, together with abutment of the edge of the pad with the lug 65 and with projections 78 flanking the lug 65 provide means for holding the pad 74 in place in the recess 72 as the top sheets of the pad 74 are pealed away from the pad 74. The pad 74 can be mounted in the recess 72 with its bottom sheet projecting through the slot 73 when the pivotable wall 55 is in its open position, and the bottom sheet will then be pierced by the teeth 76 and clamped between the pivotable wall 55 and the main part 16 as the pivotable wall 55 is subsequently moved to its closed position.

Figure 11:
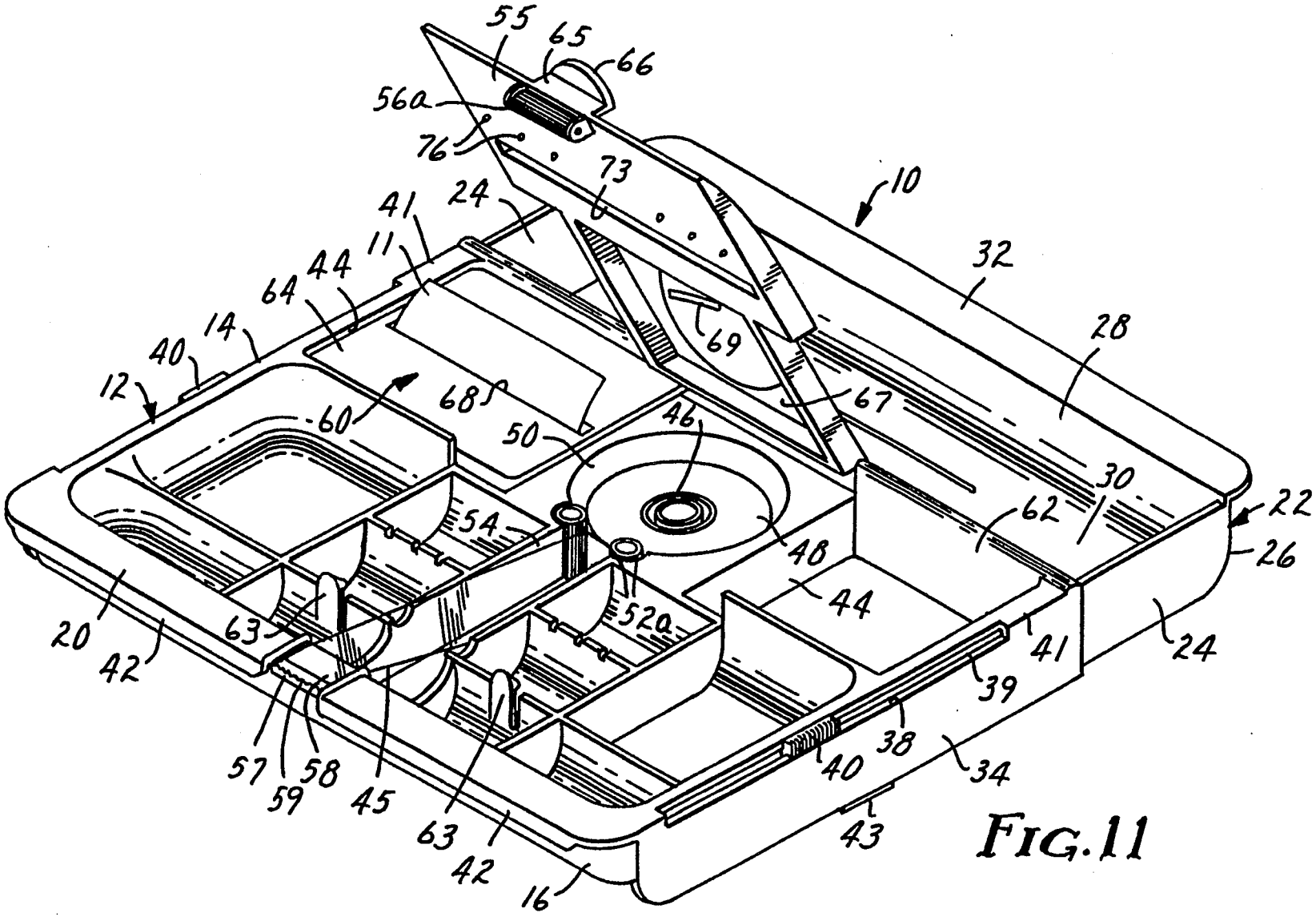
FIG. 11 is a perspective view illustrating a modification of the tray assembly of FIG. 1.

The dispenser can also be used to dispense tape comprising a backing having a coating of pressure sensitive adhesive on both major surfaces if the guide edge surface 56 and the spaced abutment surfaces 52, instead of being fixed surfaces, are provided (as is illustrated in FIG. 11) by the peripheries of rotatably mounted rollers **56*a* and 52*a* including means for limiting adhesion of layers of adhesive with the peripheries of the rollers 56*a* and 52*a*. As illustrated, the means for limiting adhesion of layers of adhesive with the peripheries of the rollers 56*a* and 52*a* is provided by the rollers 56*a* and 52*a*** having longitudinally extending spaced ridges around and defining their peripheries to limit the area of contact of the tape therewith, however, selection of a material for the rollers that is not easily adhered to by the adhesive may also provide all or a portion of that means.

The present invention has now been described with reference to one embodiment thereof. It will be apparent to those skilled in the art that many changes can be made in the embodiment described without departing from the scope of the present invention. Thus the scope of the present invention should not be limited to the structures described in this application, but only by structures described by the language of the claims and the equivalents of those structures.

We claim:

1. An adjustable tray assembly adaptable for use in desk drawers of the types having side walls with parallel upper edge surfaces spaced at various distances, said tray assembly having a generally planar top surface and comprising:

a first portion comprising walls forming a main part of said first portion comprising a plurality of receptacles having openings adjacent said top surface, and a first support lip adjacent said top surface projecting away from said main part generally parallel to said top surface adapted to be supported on the upper edge surface of one of the side walls of the desk drawer;

a second portion comprising two spaced parallel side walls having top and bottom edges and first and second ends with said side walls being elongate between said first and second ends, an end wall extending between the first ends of said side walls and having top and bottom edges, a bottom wall joined to and extending between said side and end walls adjacent the bottom edges of said side and end walls, said side and bottom walls having adjacent inner surfaces; and a second support lip projecting from adjacent the top surface of said end wall on the side of said end wall opposite said side walls and adapted to be supported on the upper edge surface of one of the side walls of the desk drawer; and means in engagement between said first and second portions for positioning at least a portion of said main part along the inner surfaces of the side and bottom walls of said second portion, for affording relative movement of said first and second portions in a direction parallel to the longitudinal direction of said side walls to change the spacing between the end wall of the second portion and the main part of said first portion and thereby the spacing between said first and second support lips so that said spacing may be manually adjusted to position said first and second support lips on the upper edge surfaces of the side walls of the drawers of different widths with the first and second portions bridging therebetween;

said means in engagement between said first and second portions comprising said walls of said first portion defining elongate spaces adapted to closely receive the side walls of said second portion with said main part along the inner surfaces of said side and bottom walls, said spaces and side walls of said first portion being adapted to afford longitudinal movement of said side walls of said second portion along said spaces to change the spacing between said first and second support lips, and means for retaining said side walls of said second portion within the spaces defined in said first portion in opposition to the separating forces therebetween caused by the weight of said first and second portions when said tray assembly is supported only by and bridges between said support lips;

said walls of said first portion include outer guide walls defining sides of said spaces opposite said main part and having top surface portions, said walls of said first portion have slots communicating with said spaces and partially defined by said top surface portions, and each of said side walls of said second portion has a lug projecting through the adjacent slot with an end portion of the lug positioned to bear against the top surface portion of the adjacent guide wall to provide a portion of said means for retaining said side walls within the spaces defined in said first portion in opposition to the separating forces therebetween caused by the weight of said first and second portions when said tray assembly is supported only by and bridges between said lips; and said walls of said first portion include walls defining a dispenser for tape of the type comprising a backing having first and second major surfaces, opposite longitudinal edges spaced by a dimension W, and a coating of pressure sensitive adhesive along the second surface of the backing, which tape is helically wound about the peripheral surface of a core having a diametrical dimension D and opposite side surfaces spaced by about said dimension W to form a roll having opposite side surfaces defined by the edge surfaces of the backing and side surfaces of the core with the first major surface of the backing being disposed radially outwardly from the second major surface of the tape in the roll, said walls defining the dispenser for tape including:

cavity defininy walls defining a cavity including a bottom wall having a normally horizontally extending support surface supporting one side surface of the roll of tape, said walls having abutment surfaces adapted to be contacted by the periphery of the roll of tape projecting generally normal to said support surface and spaced by a dimension less than the diametrical dimension of the core to define an exit opening between said abutment surfaces through which the tape may be withdrawn from the roll;

passageway defining walls defining an exit passageway extending in a direction generally parallel with said support surface and communicating with said exit opening, one of said passageway defining walls defining a guide edge surface generally parallel to said support surface on the side of the passageway opposite said support surface, defining the end of the exit passageway opposite the exit opening, and adapted to be engaged by the first surface of the backing with the guide edge surface extending generally transverse of the backing, said guide edge surface being spaced from said exit opening by at least about 2 times W to afford longitudinal twisting of said tape along said passageway by about 90 degrees between said exit opening and said guide edge surface to position the first surface of the backing along said guide edge surface, and being spaced normal to a plane coplanar with said support surface by a distance in the range of about 0.5 times W to about 1.25 times W;

tape end portion positioning walls defining a land surface adapted to have the pressure sensitive adhesive coating on the tape releasably adhered thereto, a space between said land surface and said guide edge surface affording positioning a users finger along the adhesive coated surface of the tape between said guide surface and said land surface and pealing of the tape from the land surface and subsequently withdraw tape from the roll by the user; and a cutter blade mounted at the end of said land surface opposite said guide surface and adapted for severing a length of tape withdrawn from the roll.

2. A tray assembly according to claim 1 further including means for releasably retaining said side walls of said second portion at a predetermined position longitudinally along said spaces when said tray assembly is supported only by and bridges between said support lips comprising said support lips including distal edge portions adapted to engage the outer surfaces of side walls of drawers having upper surfaces on which the support lips are supported.

3. A tray assembly according to claim 1 wherein said walls defining said land surface are disposed generally centrally along said lip on said first portion, and said exit passageway extends generally at a right angle away from said lip.

4. A tray assembly according to claim 1 wherein said spaced abutment surfaces are arcuate about axes extending generally normal to said support surface.

5. A tray assembly according to claim 1 wherein said spaced abutment surfaces are each defined by spaced parallel ridges, and are arcuate about axes extending generally normal to said support surface.

6. A dispenser for tape comprising a backing having first and second major surfaces, opposite longitudinal edges spaced by a dimension W, and a coating of pressure sensitive adhesive along the second surface of the backing, which tape is helically wound about the peripheral surface of a core having a diametrical dimension D and opposite side surfaces spaced by about said dimension W to form a roll having opposite side surfaces defined by the edge surfaces of the backing and side surfaces of the core with the first major surface of the backing being disposed radially outwardly from the second major surface of the tape in the roll, said dispenser comprising:

cavity defining walls defining a cavity including a bottom wall having a normally horizontally extending support surface supporting one side surface of the roll of tape, said walls having abutment surfaces projecting generally normal to said support surface and spaced by a dimension less than the diametrical dimension of the core to define an exit opening between said abutment surfaces through which the tape may be withdrawn from the roll;

passageway defining walls defining an exit passageway extending in a direction generally parallel with said support surface and communicating with said exit opening, one of said passageway defining walls defining a guide edge surface generally parallel to said support surface on the side of the passageway opposite said support surface, defining the end of the exit passageway opposite the exit opening, and being adapted to be engaged by the first surface of the backing with the guide edge surface extending generally transverse of the backing, said guide edge surface being spaced from said exit opening by at least about 2 times W to afford longitudinal twisting of said tape along said passageway by about 90 degrees between said exit opening and said guide edge surface to position the first surface of the backing along said guide edge surface, and being spaced normal to a plane coplanar with said support surface by a distance in the range of about 0.5 times W to about 1.25 times W, tape end positioning walls defining a land surface adapted to have the pressure sensitive adhesive coating on the tape releasably adhered thereto, a space between said land surface and said guide edge surface affording positioning of a users finger along the adhesive coated surface of the tape between said guide surface and said land surface and pealing of the tape from the land surface and subsequently withdraw tape from the roll by the user; and a cutter blade mounted at the end of said land surface opposite said guide surface and adapted for severing a length of tape withdrawn from the roll.

7. A dispenser according to claim 6 wherein said spaced abutment surfaces are arcuate about axes extending generally normal to said support surface.

8. A dispenser according to claim 6 wherein said spaced abutment surfaces are each defined by spaced parallel ridges, and are arcuate about axes extending generally normal to said support surface.

9. A dispenser according to claim 6 wherein said support surface is discontinuous and defined by a plurality of spaced wall portions to restrict adhesion between said support surface and adhesive along the side surface of the roll of tape.

10. A dispenser according to claim 6 for tape also having a coating of pressure sensitive adhesive along the first surface of the backing, wherein said guide edge surface and said spaced abutment surfaces are provided by the peripheries of rotatably mounted rollers, said rollers including means for limiting adhesion of the layers of adhesive with the peripheries of the rollers.

11. An tray assembly adaptable for use in desk drawers of the types having side walls with parallel spaced upper edge, said tray assembly having a generally planar top surface and comprising:

walls forming a main part comprising a plurality of receptacles having openings adjacent said top surface, and first and second support lips adjacent said top surface projecting away from said main part generally parallel to said top surface in opposite directions, said support lips being adapted to be supported on the upper edge surfaces of the side walls of the desk drawer;

said walls including walls defining a dispenser for tape of the type comprising a backing having first and second major surfaces, opposite longitudinal edges, and a coating of pressure sensitive adhesive along the second surface of the backing, which tape is helically wound about the peripheral surface of a core having opposite side surfaces to form a roll having opposite side surfaces defined by the edge surfaces of the backing and side surfaces of the core with the first major surface of the backing being disposed radially outwardly from the second major surface of the tape in the roll, said walls defining the dispenser for tape including:

cavity defining walls defining a cavity including a bottom wall having a normally horizontally extending support surface supporting one side surface of the roll of tape, said walls having surfaces projecting generally normal to said support surface and spaced to define an exit opening through which the tape may be withdrawn from the roll;

passageway defining walls defining an exit passageway extending in a direction generally parallel with said support surface and communicating with said exit opening, one of said passageway defining walls defining a guide edge surface generally parallel to said support surface on the side of the passageway opposite said support surface, defining the end of the exit passageway opposite the exit opening, and adapted to be engaged by the first surface of the backing with the guide edge surface extending generally transverse of the backing, said guide edge surface being spaced from said exit opening to afford longitudinal twisting of said tape along said passageway by about 90 degrees between said roll of tape and said guide edge surface to position the first surface of the backing along said guide edge surface, tape end portion positioning walls defining a land surface adapted to have the pressure sensitive adhesive coating on the tape releasably adhered thereto, a space between said land surface and said guide edge surface affording positioning a users finger along the adhesive coated surface of the tape between said guide surface and said land surface and pealing of the tape from the land surface and subsequently withdraw tape from the roll by the user; and a cutter blade mounted at the end of said land surface opposite said guide surface and adapted for severing a length of tape withdrawn from the roll;

said walls defining said land surface being disposed generally centrally along one of said lips, and said exit passageway extends generally at a right angle away from said one of said lips.

12. A tray assembly according to claim 11 wherein said walls defining said land surface are disposed generally centrally along said one of said lips.

13. A tray assembly according to claim 11 wherein said spaced surfaces projecting generally normal to said support surface to define an exit opening are abutment surfaces adapted to be contacted by the peripheral surface of the roll of tape, which abutment surfaces are spaced by a dimension less than the diametrical dimension of the core.

14. A tray assembly according to claim 13 wherein said spaced abutment surfaces are arcuate about axes extending generally normal to said support surface.

15. An tray assembly according to claim 11 wherein said tray assembly has a first portion including the first support lip, and a second portion including the second support lip; and means in engagement between said first and second portions for for affording relative movement of said first and second portions in a direction parallel to said top surface to change the spacing between said first and second support lips so that said spacing may be manually adjusted to position said first and second support lips on the upper edge surfaces of the side walls of the drawers of different widths with the first and second portions bridging therebetween.

16. A dispenser according to claim 11 wherein said support surface is discontinuous and defined by a plurality of spaced wall portions to restrict adhesion between said support surface and adhesive along the side surface of the roll of tape.

* * * * *